US009841033B2

(12) United States Patent
Henke et al.

(10) Patent No.: US 9,841,033 B2
(45) Date of Patent: Dec. 12, 2017

(54) EXHAUST GAS TURBOCHARGER HAVING AN INTERNALLY INSULATED TURBINE VOLUTE

(71) Applicants: BorgWarner Inc., Auburn Hills, MI (US); Isolite GmbH, Ludwigshafen (DE)

(72) Inventors: Waldemar Henke, Darmstadt (DE); Patric Hoecker, Landau (DE); Stefan Muenz, Ludwigshafen (DE); Matthias Kroll, Dackenheim (DE); Werner Loibl, Ingolstadt (DE); Holger Oberthuer, Ludwigshafen (DE)

(73) Assignees: BorgWarner Inc., Auburn Hills, MI (US); Isolite GmbH, Ludwigshafen (DE)

( * ) Notice: Subject to any disclaimer, the term of this patent is extended or adjusted under 35 U.S.C. 154(b) by 0 days.

(21) Appl. No.: 14/890,951

(22) PCT Filed: Apr. 30, 2014

(86) PCT No.: PCT/US2014/036042
§ 371 (c)(1),
(2) Date: Nov. 13, 2015

(87) PCT Pub. No.: WO2014/186129
PCT Pub. Date: Nov. 20, 2014

(65) Prior Publication Data

US 2016/0115823 A1 Apr. 28, 2016

(30) Foreign Application Priority Data

May 14, 2013 (DE) ..... 10 2013 008 209

(51) Int. Cl.
*F04D 29/42* (2006.01)
*F04D 29/58* (2006.01)
*F01D 25/14* (2006.01)

(52) U.S. Cl.
CPC ..... *F04D 29/4206* (2013.01); *F01D 25/145* (2013.01); *F04D 29/582* (2013.01); *F05D 2220/40* (2013.01)

(58) Field of Classification Search
CPC ..... F01D 25/145; F01D 25/14; F02B 39/00; F05D 2260/231; F04D 25/04;
(Continued)

(56) References Cited

U.S. PATENT DOCUMENTS 2,296,702 A * 9/1942 Butler et al. ..... F01D 25/125 415/175
3,310,940 A * 3/1967 Otto ..... F01D 5/048 415/117

(Continued)

FOREIGN PATENT DOCUMENTS

CN 101012772 A 8/2007
EP 0374603 A1 6/1990

(Continued)

OTHER PUBLICATIONS

International Search Report for PCT/US2014/036042 dated Apr. 9, 2014.

(Continued)

*Primary Examiner* — Bryan Lettman
*Assistant Examiner* — Timothy Solak
(74) *Attorney, Agent, or Firm* — Eric L. Doyle; Stephan A. Pendorf; Patent Central LLC

(57) ABSTRACT

A turbine housing (1) of an exhaust-gas turbocharger (15) having a turbine volute (7) which is delimited by a metallic outer shell (8) and which has an inner wall (9); and a heat (Continued)

insulation layer (10) which is arranged on the inner wall (9) and which has a heat insulation core (6A, 6B) which, on its surface (12A, 12B) facing into a volute interior space (11), is covered by a first sheet-metal shell (3A, 3B). The heat insulation core (6A, 6B) is covered, on a surface (13A, 13B, 13'B) facing toward the inner wall (9), by a second sheet-metal shell (4A and 4B respectively).

16 Claims, 6 Drawing Sheets

(58) Field of Classification Search
CPC .. F04D 29/5853; F04D 29/584; F04D 29/403; F04D 29/42; F04D 29/4206; F04D 29/4226; F04D 29/4233
USPC ..... 417/373
See application file for complete search history.

(56) References Cited

U.S. PATENT DOCUMENTS 3,928,963 A * 12/1975 Devers ..... F01D 25/14 415/178
5,020,319 A * 6/1991 Matsuura ..... F01N 3/046 123/193.5
5,403,150 A * 4/1995 McEachern, Jr. ..... F01D 25/125 384/478
5,662,457 A * 9/1997 Bechtel ..... F01D 25/145 29/889.2
7,074,009 B2 7/2006 Allmang et al.
2004/0142152 A1 7/2004 Chen et al.
2007/0175216 A1 8/2007 Kobayashi
2008/0159883 A1* 7/2008 Finkenbinder ..... F04D 29/422 417/360
2011/0252775 A1* 10/2011 Joergl ..... F01D 25/145 60/321

FOREIGN PATENT DOCUMENTS

JP 6024839 U 2/1985
JP 63111234 A 5/1988
JP H07189725 A 7/1995
WO 2008141927 A1 11/2008
WO W02008141927 A1 11/2008

OTHER PUBLICATIONS

Chinese Office Action (with English language translation) dated Sep. 12, 2016, in Chinese Application No. 201480027959.2.

* cited by examiner

EXHAUST GAS TURBOCHARGER HAVING AN INTERNALLY INSULATED TURBINE VOLUTE

BACKGROUND OF THE INVENTION

Field of the Invention

The invention relates to a turbine housing of an exhaust-gas turbocharger having an internally insulated turbine volute.

Description of the Related Art

A turbine housing of this type is known from EP 0 374 603 A1. In the case of said turbine housing, heat insulation is provided in the turbine volute, which heat insulation has a layer of a heat insulation material on which there is arranged a layer of high-temperature-resistant metal.

The disadvantage of said arrangement can be seen in the fact that the generally brittle material of the heat insulation layer poses difficulties with regard to installation.

By contrast, it is an object of the present invention to provide a turbine housing according to the preamble part of claim 1 having a heat insulation layer that can be easily installed in the turbine volute of the turbine housing.

BRIEF SUMMARY OF THE INVENTION

This object is achieved by a turbine housing of an exhaust-gas turbocharger having a turbine volute with a metallic outer shell, a heat insulation layer formed as a separate component placed into the turbine volute, the heat insulation layer having a heat insulation core and two sheet-metal shells that encase the heat insulation core.

By virtue of the heat insulation layer being formed as a separate component which, after being produced, can be placed into the turbine volute of the turbine housing, the installation process is simplified considerably, resulting in an associated reduction of the overall production outlay for the turbine housing according to the invention.

The heat insulation core is in this case preferably formed as an insulator part, in particular as a ceramic core.

The dependent claims contain advantageous developments of the invention.

The provision of two sheet-metal shells that encase the heat insulation core yields the advantage that the heat insulation core is enclosed on all sides, such that the heat insulation material, even if brittle, is held securely by the encasement. Furthermore, the provision of the first and second sheet-metal shells, which are preferably of very thin-walled form, has the effect that the heat insulation layer has a low heat capacity, which advantageously results in fast heating of the surface of the turbine volute, such that, during operation, the turbine housing no longer constitutes a heat sink that would impair the cold-start characteristics of an engine equipped with an exhaust-gas turbocharger.

It is preferably possible for the heat insulation layer to be divided into two insulation components which each have a heat insulation core which is surrounded by the first and second sheet-metal shells.

Here, the sheet-metal shells may be connected to one another, with a welded connection being particularly advantageous for this purpose.

The heat insulation components may be fixed within the turbine volute by means of a press-on part, which either is a separate pressed part or may be formed by the rear wall of a bearing housing which is connected to the turbine housing according to the invention in order to form an exhaust-gas turbocharger according to the invention.

It is particularly preferable for elevations to be provided on the inner wall of the turbine volute, which elevations firstly make it possible to realize dimensional and position tolerancing and furthermore make it possible to realize an additional insulating or heat insulation layer between the inner wall of the turbine volute and the heat insulation layer. Said additional insulation or insulating layer may for example be an air layer.

Here, the elevations may be produced either during the course of the casting of the turbine housing or, after the casting of the turbine housing, by cutting machining processes.

BRIEF DESCRIPTION OF THE SEVERAL VIEWS OF THE DRAWINGS

Further details, advantages and features of the present invention emerge from the following description of exemplary embodiments with reference to the drawing, in which.

DETAILED DESCRIPTION OF THE INVENTION

Figure 1:
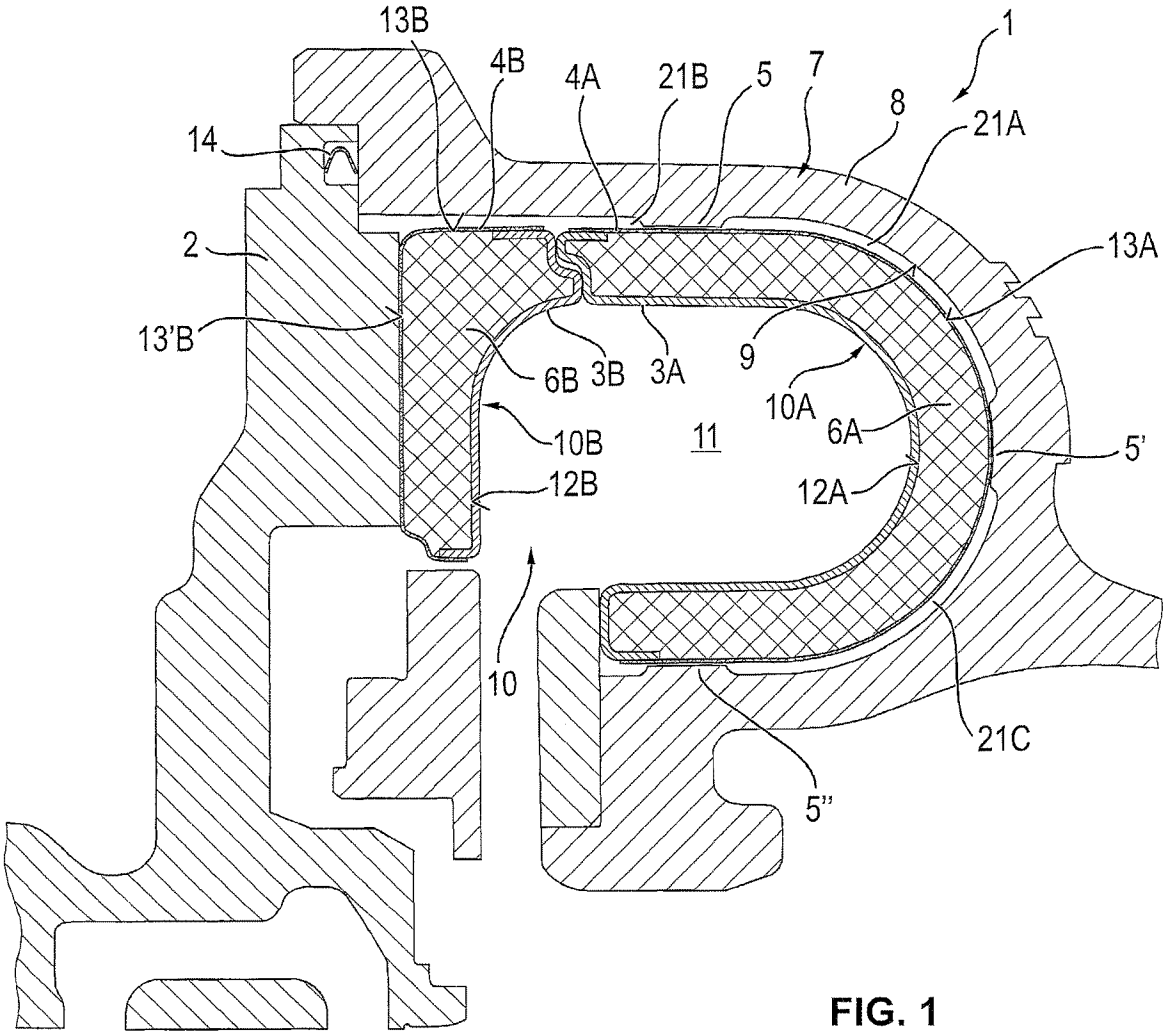
FIG. 1 shows a schematically simplified illustration of one half of a turbine housing according to the invention.
Figure 6:
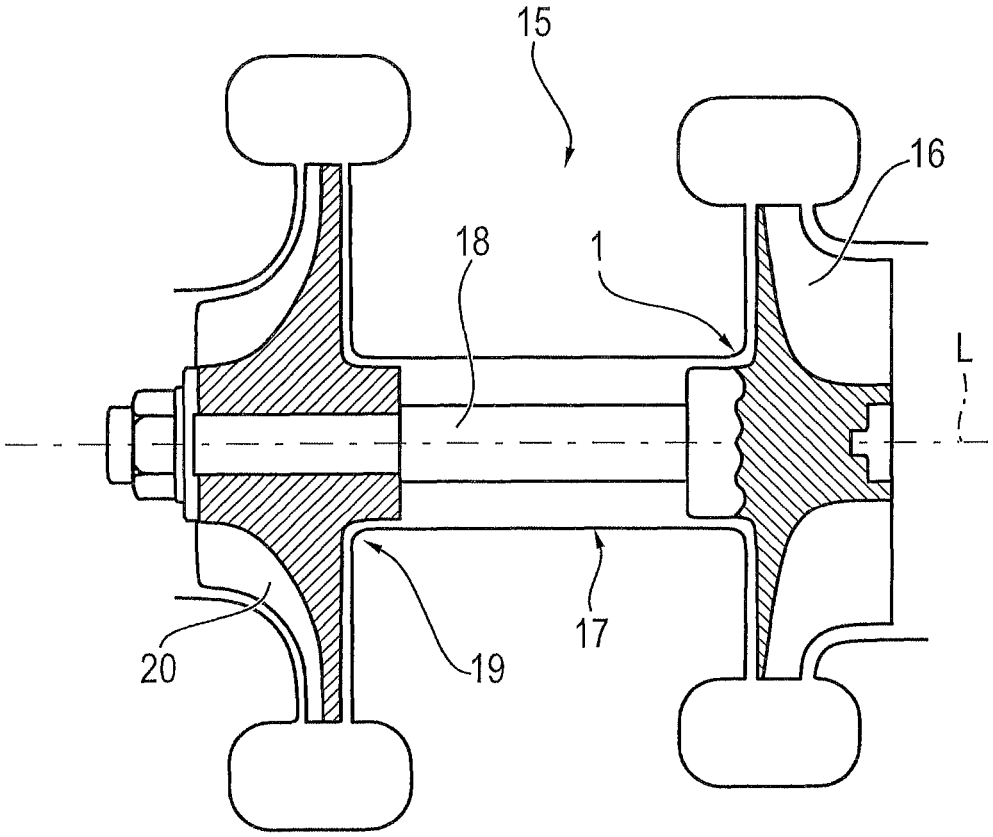
FIG. 6 shows a schematically highly simplified diagrammatic illustration of an exhaust-gas turbocharger according to the invention that can be provided with the turbine housing according to the invention.

FIG. 1 shows, in the illustration selected in FIG. 1, an upper half of a turbine housing 1 according to the invention, which turbine housing may be part of an exhaust-gas turbocharger 15 according to the invention illustrated in FIG. 6.

The turbine housing 1 has a turbine volute 7 which is delimited by a metallic outer shell 8. The metallic outer shell 8 may for example be a cast component and has an inner wall 9.

In the turbine volute 7 there is arranged a heat insulation layer 10, which in the exemplary embodiment illustrated in FIG. 1 is divided into two insulation components 10A and 10B. Each of the insulation components 10A and 10B has an associated heat insulation core 6A and 6B respectively, which heat insulation cores may be produced from a suitable material, in particular a fibrous material or ceramic material.

Each of the heat insulation cores 6A, 6B is enclosed by an arrangement of two sheet-metal shells 3A and 3B, and 4A and 4B, respectively. Here, the sheet-metal shells 3A and 3B are arranged adjacent to a volute interior space 11 and accordingly form the flow-guiding surfaces during the operation of the turbine housing 1. In the installed state, the sheet-metal shells 4A and 4B are arranged adjacent to the inner wall 9 and serve for fixing the insulation components 10A and 10B in the turbine volute 7.

As shown in detail in FIG. 1, the sheet-metal shell 3A bears against a surface 12A, which points toward the volute interior space 11, of the heat insulation core 6A. The sheet-metal shell 4A bears against a surface 13A, which points toward the inner wall 9, of the heat insulation core 6A. The encasement on all sides by the sheet-metal shells 3A and 4A results in the stabilization of the heat insulation core 6A explained in the introduction, and prevents parts of said heat insulation core 6A from passing into the turbine volute 7.

Correspondingly, the heat insulation core 6B is constructed such that the shell 3B accordingly bears against the surface 12B and the shell 4B bears against the surface 13B and against a further surface 13'B which is arranged adjacent to a press-on part 2. The insulation components 10A, 10B, which after being produced (independently of the turbine housing 1) are placed into the turbine volute 7, can be fixed in the turbine volute 7 by means of said press-on part 2.

Here, the press-on part 2 may be a separate press-on part or may be the rear wall of a bearing housing such as the bearing housing 17, illustrated in FIG. 6, of the exhaust-gas turbocharger 15.

The particularly preferred embodiment illustrated in FIG. 1 also has elevations 5, 5' and 5" which are formed on the inner wall 9 so as to point in the direction of the volute interior space 11. As a result of the provision of said elevations 5, 5' and 5", the heat insulation core 6A, when in the installed state, bears by way of its outer shell 4A against said elevations 5, 5' and 5". This yields the advantage that three further insulating or insulation layers 21A, 21B and 21C are created, which further insulating or insulation layers may for example be filled with air and yield thermal decoupling between the turbine volute 7, or the outer shell 8 thereof, and the heat insulation core 6A.

For the production of the turbine housing 1 according to the invention, said turbine housing is initially cast, and the heat insulation layer 10, or the insulation components 10A and 10B thereof, are manufactured separately in the manner explained above. It is self-evident here that, in principle, it is also possible for the heat insulation layer 10 to be divided not only into two insulation components, as shown in FIG. 1, but also into multiple such insulation components, which can then be assembled and fixed in the turbine volute 7. Furthermore a single, unitary heat insulation layer 10 is also conceivable.

After the arrangement of the insulation components 10A and 10B, said insulation components are fixed in the turbine volute 7 by the pressing-on of the press-on part 2, wherein a seal 14, for example in the form of a V-section seal, may preferably be provided between the press-on part 2 and the outer shell 8 of the turbine volute 7.

Figure 2:
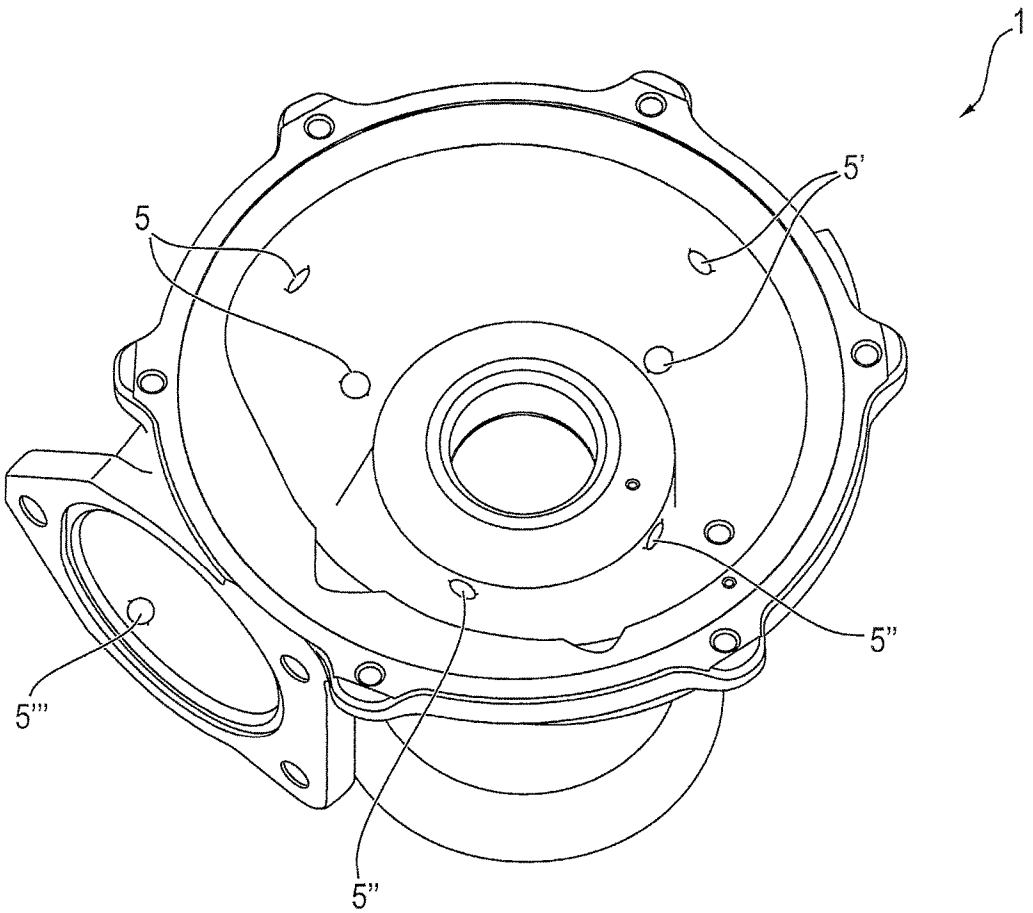
FIG. 2 shows a perspective illustration of the turbine housing according to the invention.

FIG. 2 shows the turbine housing 1 according to the invention in a perspective illustration in order to illustrate the possible position of the elevations 5, 5', 5" and 5'" already described with regard to FIG. 1. In this respect, reference is hereby explicitly made to the diagrammatic illustration of FIG. 2.

Figure 3:
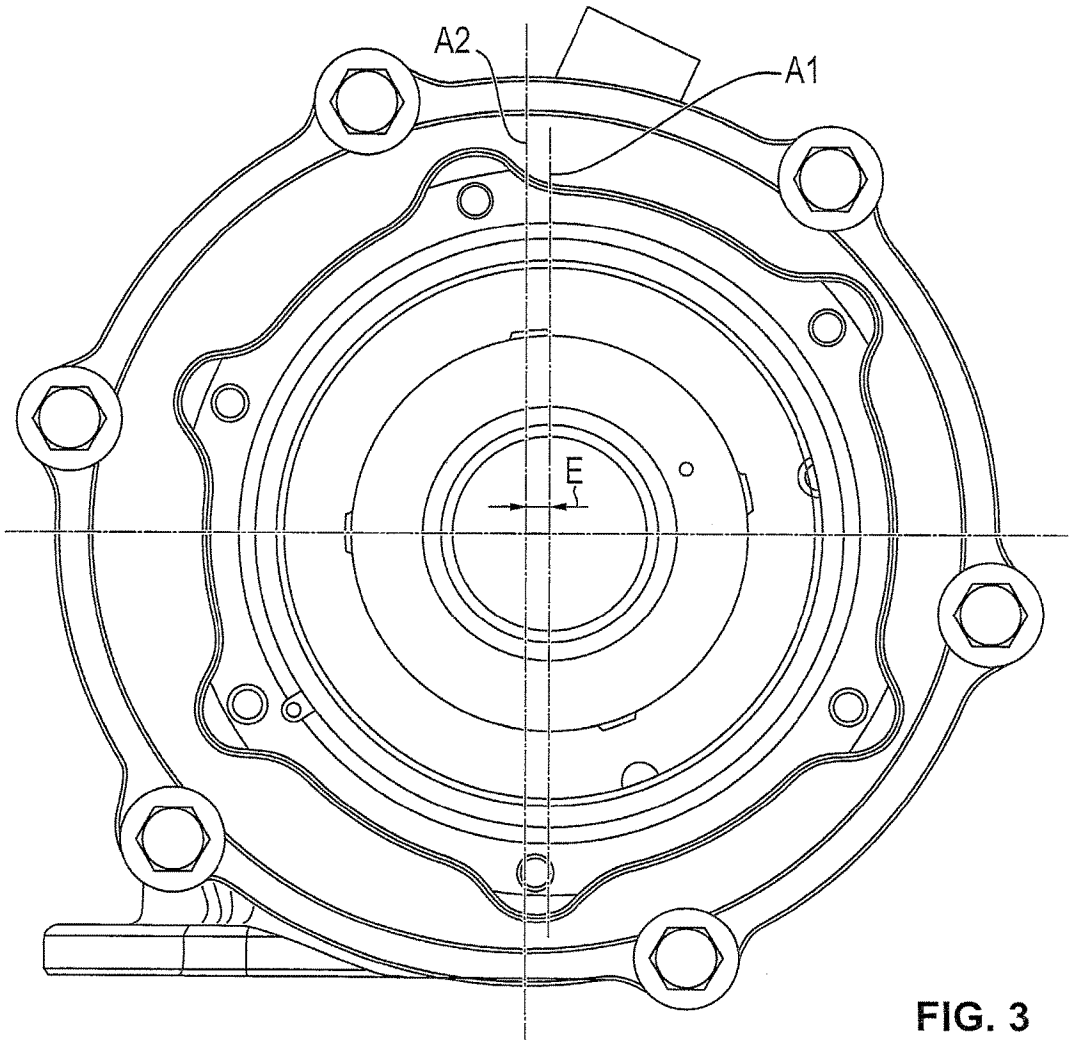
FIG. 3 shows a plan view of the turbine housing.

FIG. 3 shows a possible eccentric arrangement E of the turbine housing axis A2 with respect to the bearing housing axis or press-on part axis A1, which arrangement reduces the space requirement because the uneven space requirement of the turbine housing in the radial direction owing to a spiral shape is partially compensated.

Figure 4:
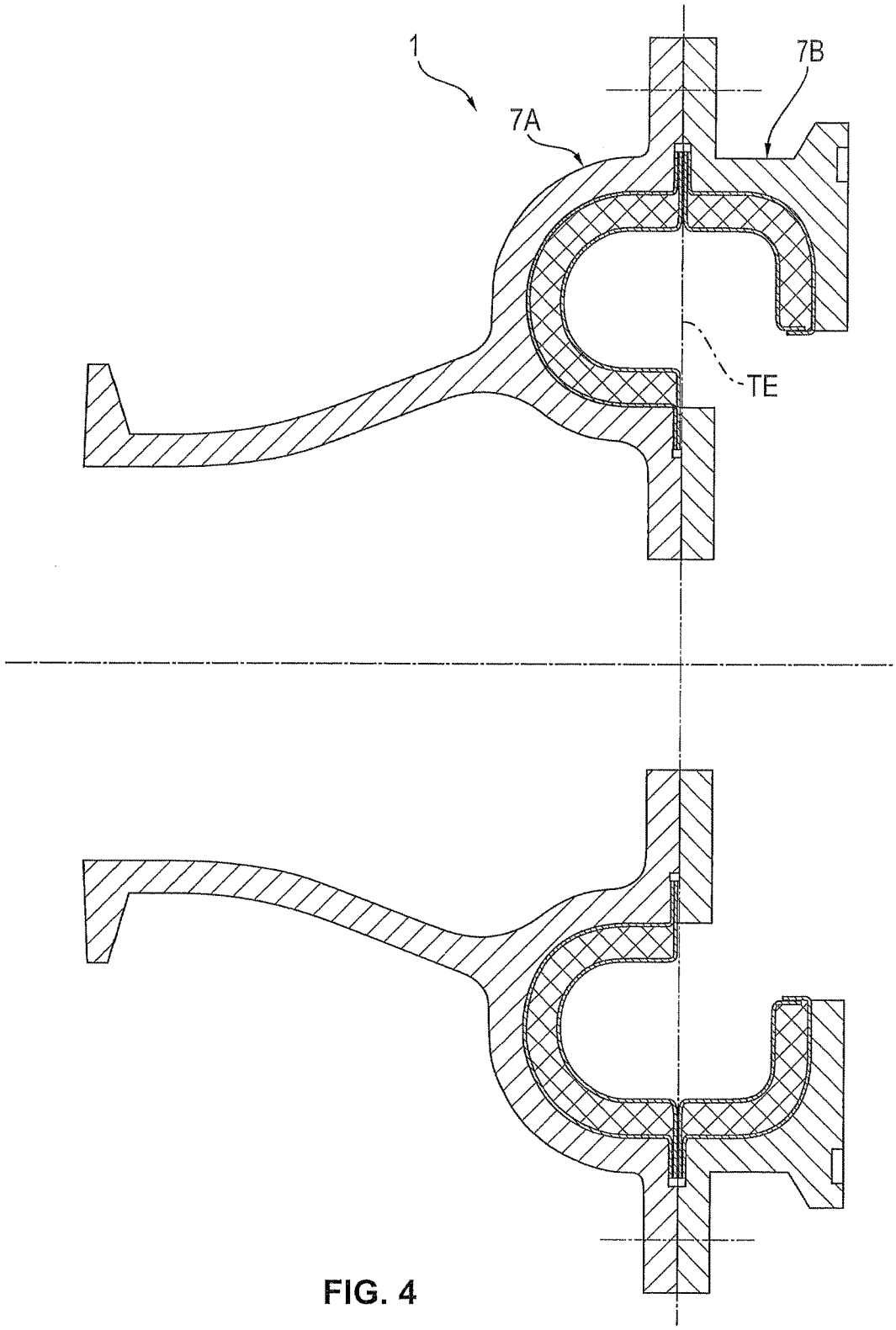
FIGS. 4 and 5 show schematically highly simplified diagrammatic illustrations of the turbine housing according to the invention, for explanation of the possible position of parting planes.
Figure 5:
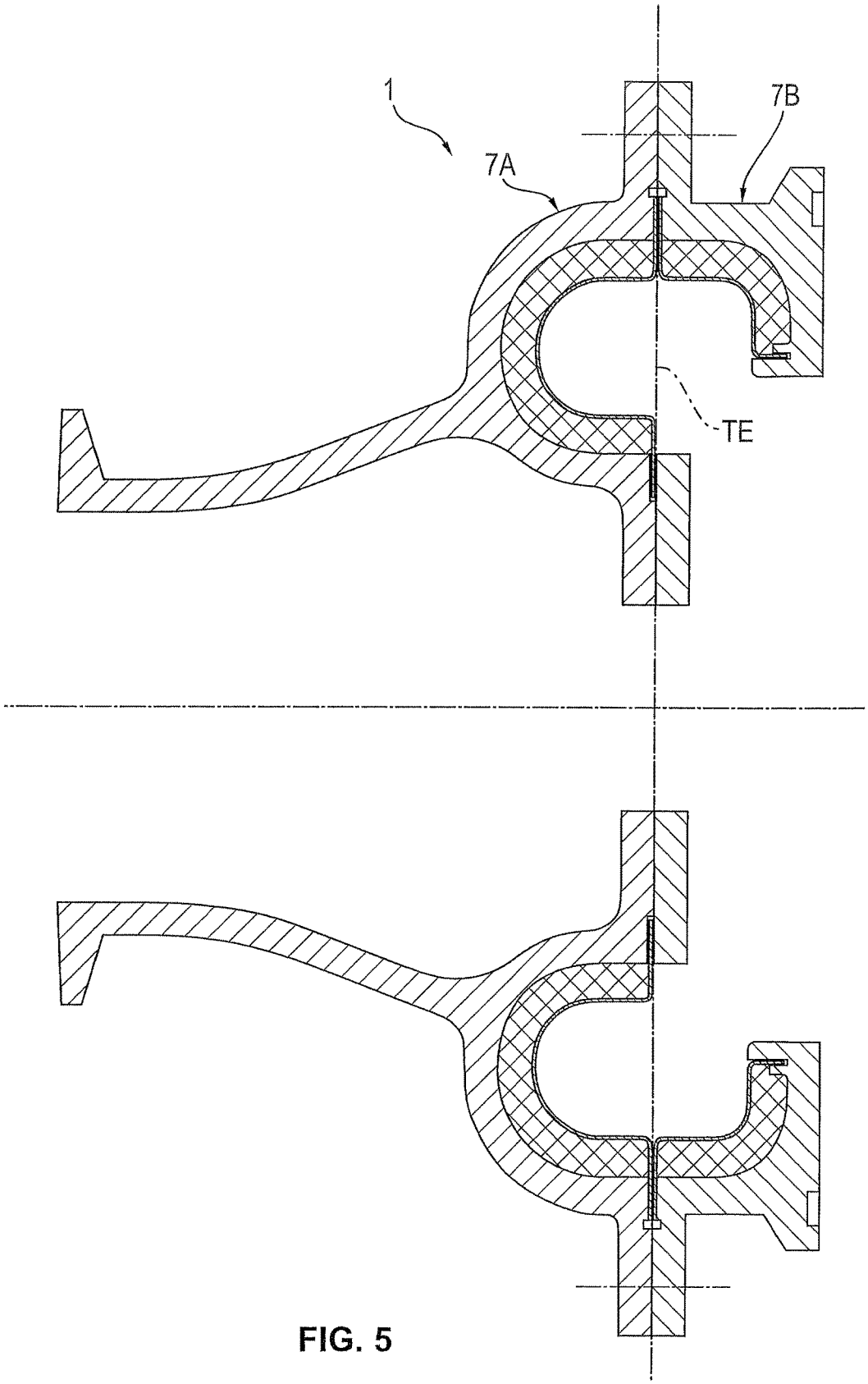

FIGS. 4 and 5 are schematically highly simplified illustrations of the turbine housing 1, which in these illustrations has a split turbine volute divided into turbine volute parts 7A and 7B. Here, the respective undercut-free parting planes TE are indicated in FIGS. 4 and 5. The turbine volute parts 7A and 7B may be connected to one another in a suitable manner, for example by means of screw connections or by means of welded connections.

FIG. 6 is a schematically highly simplified illustration of the above-mentioned exhaust-gas turbocharger 15 according to the invention having the turbine housing 1 which may be designed in accordance with the principles explained above on the basis of FIGS. 1 to 5. As is conventional, the turbine housing 1 accommodates a turbine wheel 16 which is arranged on one end of a shaft 18, on the other end of which shaft there is arranged a compressor wheel 20 which is arranged in a compressor housing 19. Here, the shaft 18 is mounted in the usual way by means of the bearing housing 17.

In addition to the above written disclosure, reference is hereby explicitly made, for supplementation thereof, to the diagrammatic illustration of the invention in FIGS. 1 to 6.

LIST OF REFERENCE SIGNS

1 Turbine housing
2 Press-on part
3A, 3B Inner sheet-metal shells
4A, 4B Outer sheet-metal shells
5, 5', 5", 5'" Elevations
6A, 6B Heat insulation core
7 Turbine volute
7A, 7B Turbine volute parts
8 Outer shell
9 Inner wall
10 Heat insulation layer
10A, 10B Insulation components
11 Volute interior space
12A, 12B, 13A, 13B, 13'B Surfaces of the heat insulation cores 6A, 6B
14 Seal
15 Exhaust-gas turbocharger
16 Turbine wheel
17 Bearing housing
18 Shaft
19 Compressor housing
20 Compressor wheel
21A, 21B, 21C Isolation or insulation layers
L Longitudinal axis of the exhaust-gas turbocharger
E Eccentricity
A1 Bearing housing axis or press-on part axis
A2 Turbine housing axis
TE Undercut-free parting planes

The invention claimed is:

1. A turbine housing (1) of an exhaust-gas turbocharger (15), having a turbine volute (7) which is delimited by a metallic outer shell (8) and which has a spiral-shaped inner wall (9); and a heat insulation layer (10) which is arranged on the inner wall (9) of the turbine volute and which has a heat insulation core (6A, 6B) comprised of a fibrous material or a ceramic material encased in a sheet-metal encasement, the encasement comprised of a first sheet-metal shell (3A, 3B) and a second sheet-metal shell (4A, 4B), wherein the first sheet-metal shell (3A, 3B) covers the heat insulation core (6A, 6B) surface (12A, 12B) facing into a volute interior space (11), the second sheet-metal shell (4A, 4B) covers the heat insulation core (6A, 6B) surface (13A, 13B, 13'B) facing toward the volute inner wall (9), the first and second sheet-metal shells together encase the heat insulation core, and the heat insulation layer (10) is formed as a separate component placed into the turbine volute (7), elevations (5; 5', 5", 5'") that project in the direction of the volute interior space (11) are arranged on the inner wall (9), and an insulation layer (21A, 21B, 21C) is arranged between the second sheet-metal shell(s) (4A, 4B), which faces the inner wall (9), and the inner wall (9).

2. The turbine housing as claimed in claim 1, wherein the heat insulation layer (10) is divided into at least first and second insulation components (10A, 10B) which are joined together in the turbine volute (7).

3. The turbine housing as claimed in claim 2, wherein the first and second insulation components (10A, 10B) each have a heat insulation core (6A and 6B respectively), wherein the first insulation component (10A) is fully enclosed by associated sheet-metal shells (3A, 4A) and the second insulation component (10B) is fully enclosed by associated sheet-metal shells (3B, 4B).

4. The turbine housing as claimed in claim 2, wherein the sheet-metal shells (3A, 3B) of the first insulation component (10A) are connected to one another and the sheet-metal shells (4A, 4B) of the second insulation component (10B) are connected to one another.

5. The turbine housing as claimed in claim 4, wherein the sheet-metal shells (3A, 3B) of the first insulation component (10A) are welded to one another and the sheet-metal shells (4A, 4B) of the second insulation component (10B) are welded to one another.

6. The turbine housing as claimed in claim 1, wherein the heat insulation layer (10) is fixed in the volute interior space (11) by a press-on part (2).

7. The turbine housing as claimed in claim 6, wherein the press-on part (2) is fixed to the turbine volute (7) with the interposition of a seal (14).

8. The turbine housing as claimed in claim 1, wherein the turbine volute (7) is divided, in undercut-free fashion, into two turbine volute parts (7A, 7B) connected to one another.

9. A turbine housing (1) of an exhaust-gas turbocharger (15), having a turbine volute (7) which is delimited by a metallic outer shell (8) and which has a spiral-shaped inner wall (9); and a heat insulation layer (10) which is arranged on the inner wall (9) of the turbine volute and which has a heat insulation core (6A, 6B) comprised of a fibrous material or a ceramic material encased in a sheet-metal encasement, the encasement comprised of a first sheet-metal shell (3A, 3B) and a second sheet-metal shell (4A, 4B), wherein the first sheet-metal shell (3A, 3B) covers the heat insulation core (6A, 6B) surface (12A, 12B) facing into a volute interior space (11), the second sheet-metal shell (4A, 4B) covers the heat insulation core (6A, 6B) surface (13A, 13B, 13'B) facing toward the volute inner wall (9), the first and second sheet-metal shells together encase the heat insulation core, and the heat insulation layer (10) is formed as a separate component placed into the turbine volute (7), elevations (5; 5', 5", 5'") that project in the direction of the volute interior space (11) are arranged on the inner wall (9), and an air insulation layer (21A, 21B, 21C) is arranged between the second sheet-metal shell(s) (4A, 4B), which faces the inner wall (9), and the inner wall (9), wherein the elevations (5, 5', 5", 5'") are produced by casting or by cutting processes.

10. An exhaust-gas turbocharger (15), having a compressor housing (19);

a bearing housing (17); and a turbine housing (1) which has:

a turbine volute (7) which is delimited by a metallic outer shell (8) and which has an inner wall (9); and a heat insulation layer (10) which is arranged on the inner wall (9) of the turbine volute and which has a heat insulation core (6A, 6B) comprised of a fibrous material or a ceramic material encased in a sheet-metal encasement, the encasement comprised of a first sheet-metal shell (3A, 3B) and a second sheet-metal shell (4A, 4B), wherein the first sheet-metal shell (3A, 3B) covers the heat insulation core (6A, 6B) surface (12A, 12B) facing into a volute interior space (11), the second sheet-metal shell (4A, 4B) covers the heat insulation core (6A, 6B) surface (13A, 13B, 13'B) facing toward the volute inner wall (9), the first and second sheet-metal shells together encase the heat insulation core, and the heat insulation layer (10) is formed as a separate component placed into the turbine volute (7), elevations (5; 5', 5", 5'") that project in the direction of the volute interior space (11) are arranged on the inner wall (9), and an insulation layer (21A, 21B, 21C) is arranged between the second sheet-metal shell(s) (4A, 4B), which faces the inner wall (9), and the inner wall (9).

11. The exhaust-gas turbocharger as claimed in claim 10, wherein the heat insulation layer (10) is divided into at least first and second insulation components (10A, 10B) which are joined together in the turbine volute (7).

12. The exhaust-gas turbocharger as claimed in claim 11, wherein the first and second insulation components (10A, 10B) each have a heat insulation core (6A and 6B respectively), wherein the first insulation component (10A) is fully enclosed by associated sheet-metal shells (3A, 4A) and the second insulation component (10B) is fully enclosed by associated sheet-metal shells (3B, 4B).

13. The exhaust-gas turbocharger as claimed in claim 11, wherein the sheet-metal shells (3A, 3B) of the first insulation component (10A) are connected to one another and the sheet-metal shells (4A, 4B) of the second insulation component (10B) are connected to one another.

14. The exhaust-gas turbocharger as claimed in claim 10, wherein the heat insulation layer (10) is fixed in the volute interior space (11) by a press-on part (2).

15. The exhaust-gas turbocharger as claimed in claim 10, wherein elevations (5; 5', 5", 5'") that project in the direction of the volute interior space (11) are arranged on the inner wall (9).

16. The exhaust-gas turbocharger as claimed in claim 10, wherein the turbine volute (7) is divided, in undercut-free fashion, into two turbine volute parts (7A, 7B) connected to one another.

* * * * *